US007464836B1

(12) United States Patent
Deweese

(10) Patent No.: US 7,464,836 B1
(45) Date of Patent: Dec. 16, 2008

(54) LOCKABLE BEVERAGE DISPENSER

(76) Inventor: Edna B. Deweese, Route 1, Box 482 C, Leon, WV (US) 25123

( * ) Notice: Subject to any disclaimer, the term of this patent is extended or adjusted under 35 U.S.C. 154(b) by 695 days.

(21) Appl. No.: 11/038,839

(22) Filed: Jan. 21, 2005

(51) Int. Cl.
*B67D 5/00* (2006.01)

(52) U.S. Cl. ..... 222/153.03; 220/592.16

(58) Field of Classification Search ..... 222/153.03, 222/153.1, 153.01, 153.02, 131, 183, 146.6; 62/457.3–457.9; 220/592.08, 592.17–592.21, 220/843, 841, 845, 608, 62.12, 592.01, 592.16, 220/908, 835, 847; D7/313
See application file for complete search history.

(56) References Cited

U.S. PATENT DOCUMENTS

| | | | | |
|---|---|---|---|---|
| 1,607,347 | A | 11/1926 | Hemman | |
| 2,285,096 | A * | 6/1942 | Sailer et al. | 62/392 |
| D210,307 | S | 2/1968 | Branscum | |
| 3,690,708 | A * | 9/1972 | Worley et al. | 292/101 |
| 4,349,120 | A * | 9/1982 | DiNardo | 220/840 |
| 4,907,716 | A | 3/1990 | Wankel et al. | |
| 4,925,041 | A * | 5/1990 | Pehr | 215/216 |
| 5,140,833 | A | 8/1992 | Whalen | |
| 5,275,029 | A | 1/1994 | Myers | |
| 5,328,050 | A * | 7/1994 | Hyatt | 220/506 |
| 5,884,795 | A * | 3/1999 | Godbersen et al. | 220/23.86 |
| 5,938,063 | A * | 8/1999 | Hoftman | 220/326 |
| 6,244,458 | B1 * | 6/2001 | Frysinger et al. | 220/592.09 |
| 6,378,719 | B1 | 4/2002 | Kaiser | |
| 6,575,155 | B2 | 6/2003 | Brennan | |
| 7,255,228 | B2 * | 8/2007 | Kim | 206/320 |
| 7,269,969 | B2 * | 9/2007 | Strickland et al. | 62/400 |
| 7,328,818 | B2 * | 2/2008 | Prabucki | 222/146.6 |

* cited by examiner

*Primary Examiner*—Lien T Ngo

(57) ABSTRACT

A beverage dispenser includes a container that has a ribbed outer surface and a chamfered portion formed therein. A manually operable spout is in fluid communication with the container and interfitted within the chamfered portion such that a user may nest a beverage container subjacent to the spout adjoined to the chamfered portion during operating conditions. An annular lid is centrally registerable with the axis and conforms to a top opening of the container such that the annular lid becomes conjoined with the container for advantageously and effectively isolating undesirable foreign debris from the fluid housed within the cavity. Such an annular lid and container have coextensive diameters respectively. A mechanism is included for removably locking the annular lid to the container such that a user may conveniently completely detach and remove the annular lid from the container by articulating the lid to an open position.

14 Claims, 3 Drawing Sheets

LOCKABLE BEVERAGE DISPENSER

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a beverage dispenser and, more particularly, to a lockable beverage dispenser for prohibiting unauthorized tampering of fluid housed therein.

2. Prior Art

Liquid containers, such as water coolers, are often employed at outdoor recreational events and sporting environments, such as golf courses, parks, and recreational areas of all types. The coolers are typically strategically placed at tees and greens, along park paths, or in pavilions to provide a source of liquid refreshment. The containers are insulated and, most often, filled with water. Presently, one of the most common liquid containers employed for this purpose is a ten-gallon insulated cooler. The ten-gallon cooler is often cylindrical in shape with a spigot located at the lower end thereof. One such cooler in popular use today is manufactured by Igloo.

In general, these coolers are effective in their use for storing and keeping a large quantity of fluid cool. Such coolers, however, do not provide a feasible means for locking the lid thereof in order to prevent an unauthorized person from tampering with the contents thereof. This lack of security especially raises concerns when the coolers are being employed in public areas where many people have access thereto, and it is virtually impossible to monitor the beverage dispenser at all times.

Accordingly, a need remains for a lockable beverage dispenser in order to overcome the above-noted shortcomings. The present invention satisfies such a need by providing a lockable beverage dispenser that is easy to use, provides improved security and, is durable and convenient in design. Such a beverage dispenser prevents water, and other beverages, from being tampered with, which could result in sickness or even death. The strong and durable construction of the beverage dispenser enables it to be used for many years.

BRIEF SUMMARY OF THE INVENTION

In view of the foregoing background, it is therefore an object of the present invention to provide a lockable beverage dispenser. These and other objects, features, and advantages of the invention are provided by a beverage dispenser for prohibiting unauthorized tampering of fluid housed therein.

The beverage dispenser includes a container that has a ribbed outer surface and a chamfered portion formed therein. Such an outer surface is formed from fluid impermeable material and has a longitudinal axis centrally disposed thereto such that the outer surface is equidistantly and radially offset from the axis. The chamfered portion travels upwardly from a bottom shoulder of the container and terminates beneath the open top end portion.

A manually operable spout is in fluid communication with the container and interfifted within the chamfered portion such that a user may nest a beverage container subjacent to the spout adjoined to the chamfered portion during operating conditions.

An annular lid is centrally registerable with the axis and conforms to a top opening of the container such that the annular lid becomes conjoined with the container for advantageously and effectively isolating undesirable foreign debris from the fluid housed with the cavity. Such an annular lid and container have coextensive diameters respectively.

A mechanism is included for removably locking the annular lid to the container such that a user may conveniently completely detach and remove the annular lid from the container by articulating the lid to an open position. Such a locking mechanism preferably includes a first plurality of flange portions conjoined to the outer surface of the container and laterally protruding away therefrom. A second plurality of flange portions are conjoined to an outer edge portion of the annular lid and are vertically registerable with the first flange portions. A locking member is removably traversable through associated ones of the first and second flange portions and cooperates therewith for advantageously maintaining the annular lid securely conjoined to the container.

One of the first flange portions preferably includes a hooked hinge member monolithically formed therewith and is arranged such that the hinge member can be selectively biased with one of the second flange portions such that the annular lid is conveniently repeatedly adaptable between open and closed positions. Such a hinge member is preferably detachable from the second flange portion such that the user may sever the annular lid from the container during non-operating conditions. The hinge member preferably faces outwardly from the outer surface when the annular lid is cradled on the container.

The container may further include a plurality of coextensive handles monolithically formed with the outer surface of the container. Such coextensive handles are diametrically offset and span orthogonally outward from the outer surface respectively.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
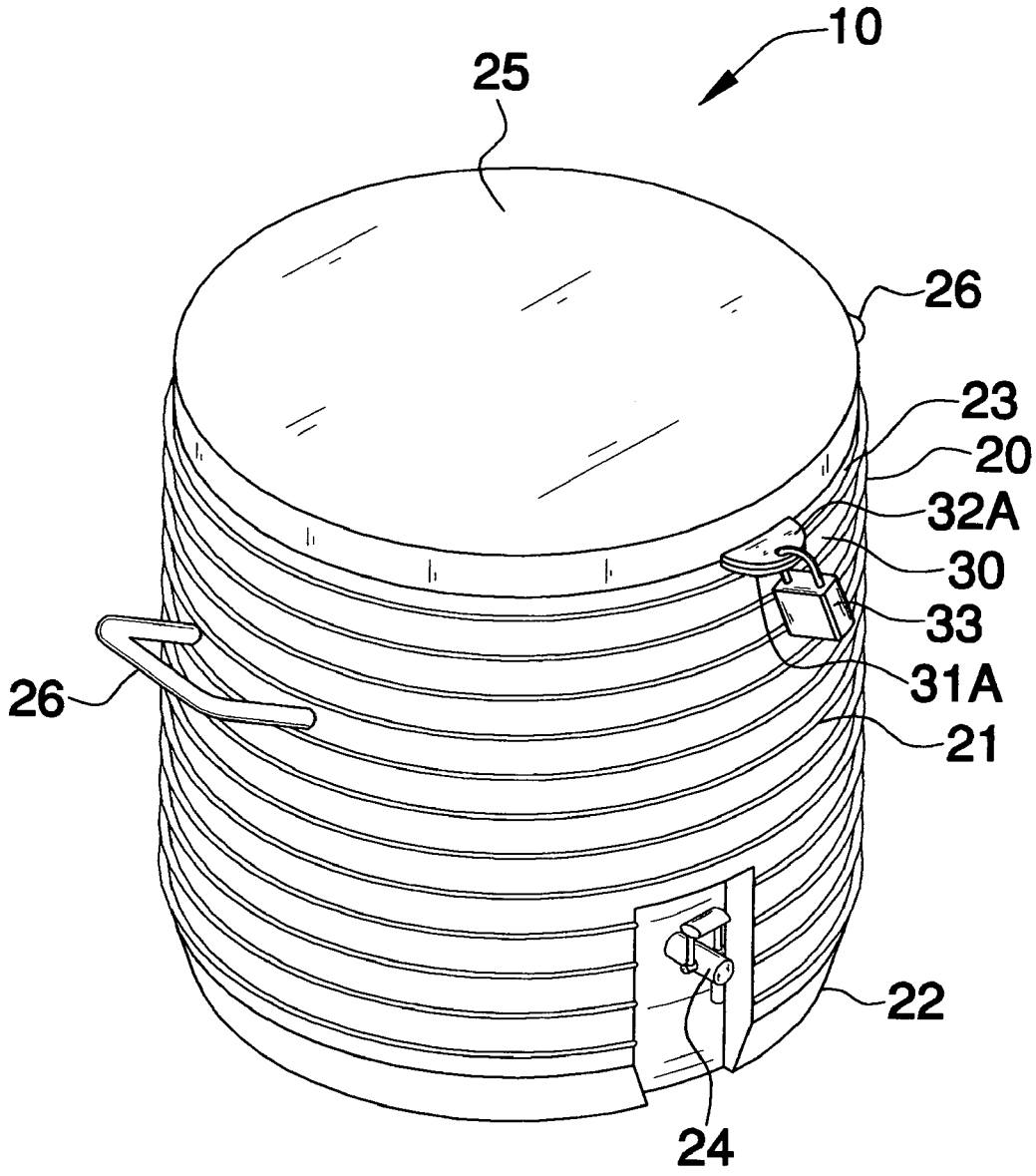
FIG. 1 is a perspective view showing a lockable beverage dispenser, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-4 by the reference numeral 10 and is intended to provide a lockable beverage dispenser. It should be understood that the apparatus 10 may be used to protect many different types of beverages and should not be limited in use to only store, dispense and protect water.

Referring initially to FIG. 1, the apparatus 10 includes a container 20 that has a ribbed outer surface 21 and a chamfered portion (not shown) formed therein. Such an outer surface 21 is formed from fluid impermeable material and has a longitudinal axis centrally disposed thereto such that the outer surface 21 is equidistantly and radially offset from the axis. The ribbed nature of the outer surface 21 advantageously assists a user in maintaining a grip of the container 20 during lifting and carrying operations. The chamfered portion travels upwardly from a bottom shoulder 22 of the container 20 and terminates beneath the open top end portion 23. Of course, the container 20 may be produced in a variety of different shapes, sizes and colors, as is obvious to a person of ordinary skill in the art.

Figure 2:
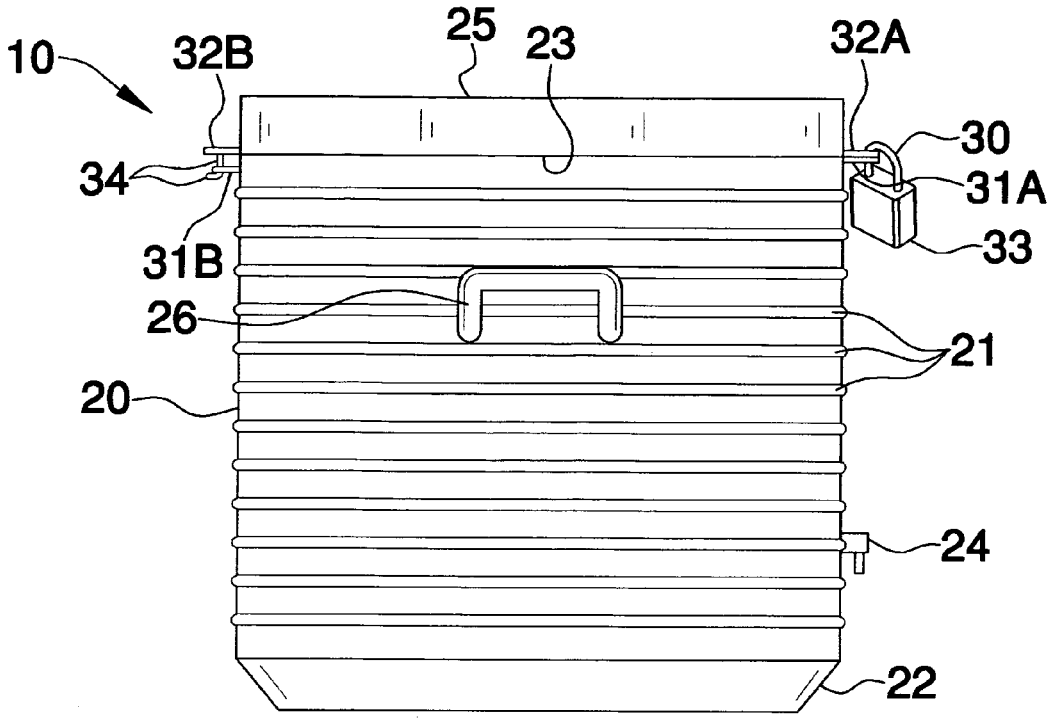
FIG. 2 is a side elevational view of the dispenser shown in FIG. 1.

Referring to FIGS. 1 and 2, a manually operable spout 24 is in fluid communication with the container 20 and interfitted within the chamfered portion such that a user may nest a beverage container subjacent to the spout 24 adjoined to the chamfered portion during operating conditions.

Referring to FIGS. 1 through 4, an annular lid 25 is centrally registerable with the axis and conforms to a top opening (not shown) of the container 20 such that the annular lid 25 becomes conjoined with the container 20 for advantageously and effectively isolating undesirable foreign debris from the fluid housed with the cavity. Such an annular lid 25 and container 20 have coextensive diameters respectively. Of course, the lid 25 may be produced in many different shapes, sizes and colors, so as to conform to the shape, size and color of the container 20, as is obvious to a person of ordinary skill in the art.

Figure 3:
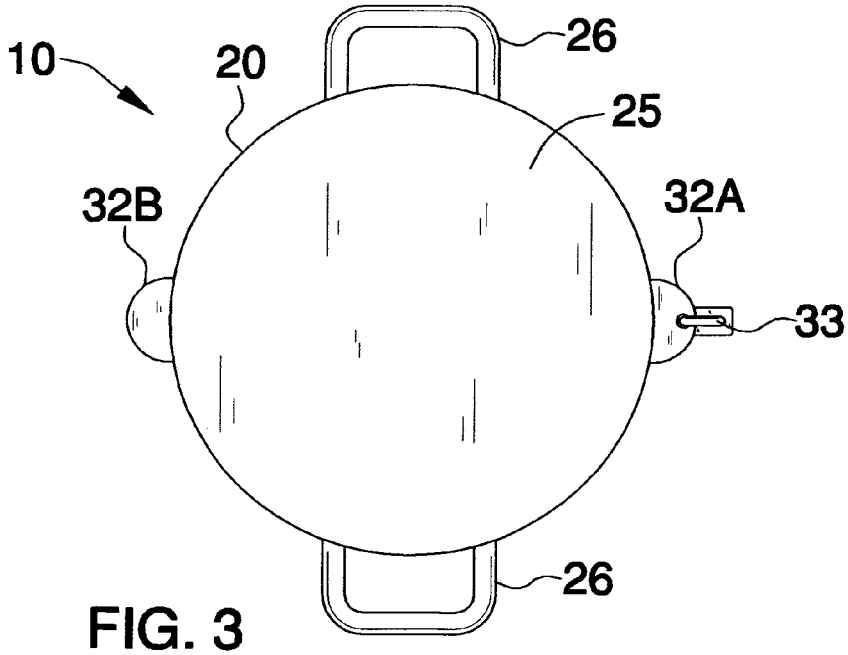
FIG. 3 is a top plan view of the dispenser shown in FIG. 2.

Referring to FIGS. 1 through 3, a mechanism 30 is included for removably locking the annular lid 25 to the container 20 such that a user may conveniently completely detach and remove the annular lid 25 from the container 20 by articulating the lid 25 to an open position. Such a locking mechanism 30 includes a first plurality of flange portions 31 conjoined to the outer surface 21 of the container 20 and laterally protruding away therefrom. A second plurality of flange portions 32 are conjoined to an outer edge portion of the annular lid 25 and are vertically registerable with the first flange portions 31. A locking member 33 is removably traversable through associated ones 31A, 32A of the first 31 and second 32 flange portions and cooperates therewith for advantageously maintaining the annular lid 25 securely conjoined to the container 20. During operating conditions, the locking member 33 advantageously prohibits access to the contents of the container 20, thus giving the user peace of mind after setting the container 20 out.

Figure 4:
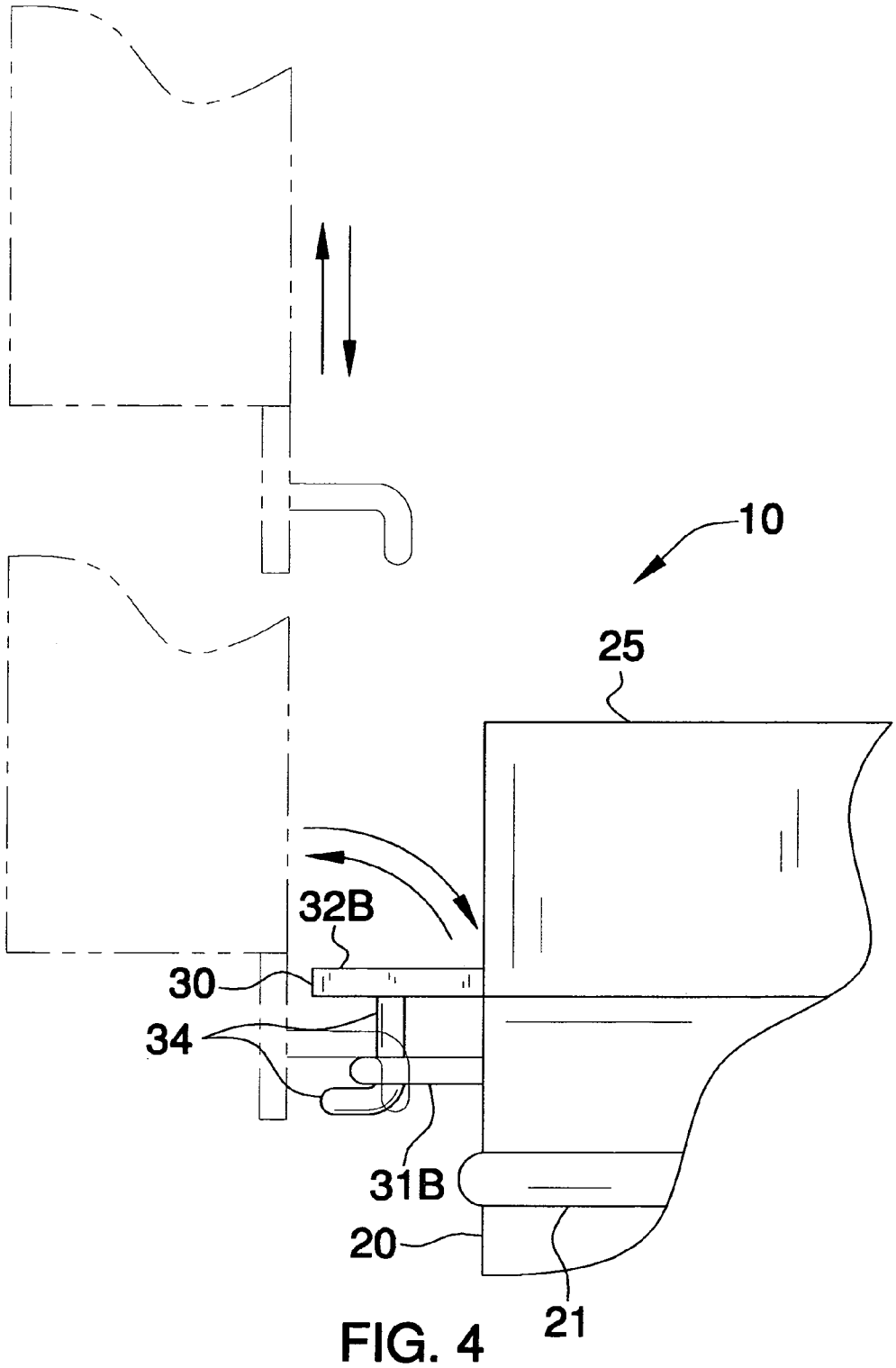
FIG. 4 is an enlarged side elevational view of the dispenser shown in FIG. 2, showing the hinge member and its pivotal relationship with the first and second flange portions.

Referring to FIGS. 2 and 4, one of the first flange portions 31B includes a hooked hinge member 34 monolithically formed therewith and arranged such that the hinge member 34 can be selectively biased with one of the second flange portions 32B such that the annular lid 25 is conveniently repeatedly adaptable between open and closed positions. Such a hinge member 34 is detachable from the one second flange portion 32B such that the user may conveniently sever the annular lid 25 from the container 20 during non-operating conditions. The hinge member 34 faces outwardly from the outer surface 21 when the annular lid 25 is cradled on the container 20.

Referring to FIGS. 1 through 3, the container 20 further includes a plurality of coextensive handles 26 monolithically formed with the outer surface 21 of the container 20, which advantageously greatly increases the ease with which the container 20 is transported between remote locations. Such coextensive handles 26 are diametrically offset and span orthogonally outward from the outer surface 21 respectively.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A beverage dispenser for prohibiting unauthorized tampering of fluid housed therein, said beverage dispenser comprising:

a container having a ribbed outer surface and a chamfered portion formed therein, said outer surface being formed from fluid impermeable material and having a longitudinal axis centrally disposed thereto such that said outer surface is equidistantly and radially offset from the axis;

a manually operable spout in fluid communication with said container and interfitted within said chamfered portion such that a user may nest a beverage container subjacent said spout and adjoined to said chamfered portion during operating conditions;

an annular lid centrally registerable with the axis and conforming to a top opening of said container such that said annular lid becomes conjoined with said container for effectively isolating undesirable foreign debris from the fluid housed with the cavity; and means for removably locking said annular lid to said container such that a user may completely detach and remove said annular lid from said container by articulating said lid to an open position and thereafter vertically lift said lid along a linear travel path defined parallel to the longitudinal axis of said container.

2. The beverage dispenser of claim 1, wherein said locking means comprises:

a first plurality of flange portions conjoined to said outer surface of said container and laterally protruding away therefrom;

a second plurality of flange portions conjoined to an outer edge portion of said annular lid and being vertically registerable with said first flange portions; and a locking member removably traversable through associated ones of said first and second flange portions and cooperating therewith for maintaining said annular lid securely conjoined to said container.

3. The beverage dispenser of claim 2, wherein one of said second flange portions comprises: a hooked hinge member monolithically formed therewith and being arranged such that said hinge member is selectively biased with one of said first flange portions, said hinge member being repeatedly adapted along an arcuate path defined exterior of said outer surface of said container as said annular lid is repeatedly adaptable between open and closed positions respectively.

4. The beverage dispenser of claim 3, wherein said hinge member is detachable from said one first flange portion such that the user may sever said annular lid from said container during non-operating conditions.

5. The beverage dispenser of claim 1, wherein said container further comprises: a plurality of coextensive handles monolithically formed with said outer surface of said container, said coextensive handles being diametrically offset and spanning orthogonally outward from said outer surface respectively.

6. The beverage dispenser of claim 3, wherein said hinge member faces outwardly from said outer surface when said annular lid is cradled on said container.

7. A beverage dispenser for prohibiting unauthorized tampering of fluid housed therein, said beverage dispenser comprising:

a container having a ribbed outer surface and a chamfered portion formed therein, said outer surface being formed from fluid impermeable material and having a longitudinal axis centrally disposed thereto such that said outer surface is equidistantly and radially offset from the axis;

a manually operable spout in fluid communication with said container and interfitted within said chamfered portion such that a user may nest a beverage container subjacent said spout and adjoined to said chamfered portion during operating conditions;

an annular lid centrally registerable with the axis and conforming to a top opening of said container such that said annular lid becomes conjoined with said container for effectively isolating undesirable foreign debris from the fluid housed with the cavity, said annular lid and said container having coextensive diameters respectively; and means for removably locking said annular lid to said container such that a user may completely detach and remove said annular lid from said container by articulating said lid to an open position and thereafter vertically lift said lid along a linear travel path defined parallel to the longitudinal axis of said container.

8. The beverage dispenser of claim 7, wherein said locking means comprises:

a first plurality of flange portions conjoined to said outer surface of said container and laterally protruding away therefrom;

a second plurality of flange portions conjoined to an outer edge portion of said annular lid and being vertically registerable with said first flange portions; and a locking member removably traversable through associated ones of said first and second flange portions and cooperating therewith for maintaining said annular lid securely conjoined to said container.

9. The beverage dispenser of claim 8, wherein one of said second flange portions comprises: a hooked hinge member monolithically formed therewith and being arranged such that said hinge member is selectively biased with one of said first flange portions, said hinge member being repeatedly adapted along an arcuate path defined exterior of said outer surface of said container as said annular lid is repeatedly adaptable between open and closed positions respectively.

10. The beverage dispenser of claim 9, wherein said hinge member is detachable from said one first flange portion such that the user may sever said annular lid from said container during non-operating conditions.

11. The beverage dispenser of claim 7, wherein said container further comprises: a plurality of coextensive handles monolithically formed with said outer surface of said container, said coextensive handles being diametrically offset and spanning orthogonally outward from said outer surface respectively.

12. The beverage dispenser of claim 9, wherein said hinge member faces outwardly from said outer surface when said annular lid is cradled on said container.

13. A beverage dispenser for prohibiting unauthorized tampering of fluid housed therein, said beverage dispenser comprising:

a container having a ribbed outer surface and a chamfered portion formed therein, said outer surface being formed from fluid impermeable material and having a longitudinal axis centrally disposed thereto such that said outer surface is equidistantly and radially offset from the axis, said chamfered portion traveling upwardly from a bottom shoulder of said container and terminating beneath said open top end portion;

a manually operable spout in fluid communication with said container and interfitted within said chamfered portion such that a user may nest a beverage container subjacent said spout and adjoined to said chamfered portion during operating conditions;

an annular lid centrally registerable with the axis and conforming to a top opening of said container such that said annular lid becomes conjoined with said container for effectively isolating undesirable foreign debris from the fluid housed with the cavity, said annular lid and said container having coextensive diameters respectively; and means for removably locking said annular lid to said container such that a user may completely detach and remove said annular lid from said container by articulating said lid to an open position and thereafter vertically lift said lid along a linear travel path defined parallel to the longitudinal axis of said container;

wherein said locking means comprises a first plurality of flange portions conjoined to said outer surface of said container and laterally protruding away therefrom;

a second plurality of flange portions conjoined to an outer edge portion of said annular lid and being vertically registerable with said first flange portions; and a locking member removably traversable through associated ones of said first and second flange portions and cooperating therewith for maintaining said annular lid securely conjoined to said container;

wherein one of said second flange portions comprises a hooked hinge member monolithically formed therewith and being arranged such that said hinge member is selectively biased with one of said first flange portions, said hinge member being repeatedly adapted along an arcuate path defined exterior of said outer surface of said container as said annular lid is repeatedly adaptable between open and closed positions respectively;

wherein said hinge member is detachable from said one first flange portion such that the user may sever said annular lid from said container during non-operating conditions;

wherein said hinge member faces outwardly from said outer surface when said annular lid is cradled on said container.

14. The beverage dispenser of claim 13, wherein said container further comprises: a plurality of coextensive handles monolithically formed with said outer surface of said container, said coextensive handles being diametrically offset and spanning orthogonally outward from said outer surface respectively.

* * * * *